US006089448A

United States Patent [19]

Seki

[11] Patent Number: 6,089,448

[45] Date of Patent: Jul. 18, 2000

[54] PACKING CASE

[75] Inventor: Seizo Seki, Miyagi, Japan

[73] Assignee: Sony Corporation, Tokyo, Japan

[21] Appl. No.: 09/313,586

[22] Filed: May 18, 1999

[30] Foreign Application Priority Data

May 20, 1998 [JP] Japan ..... 10-138634

[51] Int. Cl.[7] ..... B65D 5/28

[52] U.S. Cl. ..... 229/193; 206/387.1; 229/198.2

[58] Field of Search ..... 229/193, 198.2, 229/941; 206/387.1

[56] References Cited

U.S. PATENT DOCUMENTS

| | | | |
|---|---|---|---|
| 2,015,413 | 9/1935 | Snyder | 229/193 |
| 3,276,659 | 10/1966 | Gross | 229/193 |
| 3,385,505 | 5/1968 | Beals | 229/193 |
| 4,445,634 | 5/1984 | Sato | 206/387.1 |
| 5,337,948 | 8/1994 | Newsome et al. | 229/193 |
| 5,560,484 | 10/1996 | Tomisawa et al. | 206/387.1 |
| 5,803,351 | 9/1998 | Nielsen | 229/198.1 |

FOREIGN PATENT DOCUMENTS

| | | | |
|---|---|---|---|
| 36/178033 | 9/1985 | Japan | 206/387.1 |

*Primary Examiner*—Gary E. Elkins
*Attorney, Agent, or Firm*—Jay H. Maioli

[57] ABSTRACT

In a box-shaped packing case 20 having an overlap portion at which a third folding plate 24 folded from a first holding direction is superposedly adhesively attached onto first and second folding plates 22, 23 which are folded from two directions different from the first folding direction of the third folding plate 24 so that the boundary portions thereof are not overlapped with each other, the shape of the boundary portion between the first and second folding plates 22, 23 when the first and second folding plates 22, 23 are folded is designed so that the length of an adhesion area to which the third folding plate 24 adheres approaches to the length of the third folding plate 24 at a maximum irrespective of the boundary portion.

2 Claims, 5 Drawing Sheets

PACKING CASE

BACKGROUND OF THE INVENTION

1. Field of the Invention

The present invention relates to a box-shaped packing case used to accommodate a video tape cassette or the like.

2. Description of the Related Art

A conventional packing case, for example, a box-shaped packing case used to accommodate a video tape cassette or the like, is designed so that each of both end portions of the packing case 50 in its longitudinal direction (up-and-down direction in FIG. 1) thereof is constructed by an overlap portion. That is, the overlap portion is constructed as follows. First, first and second folding plates 52 and 53 are folded from two directions. The outer shape of each folding plate 52, 53 at the boundary portion therebetween is designed so that they are not overlapped with each other when they are folded (see FIGS. 2 to 4).

As shown in FIG. 1, a third folding plate 54 is folded from another direction so as to be overlaid on the first and second folding plates 52, 53. Liquid paste 56 is coated at a predetermined position shown in FIG. 1 on the first folding plate 52 in advance, and the third folding plate 54 thus folded adheres onto the first folding plate 52 through the liquid paste 56.

In the conventional packing case 50 as described above, however, the boundary portion between the first and second folding plates 52 and 53 when they are folded is formed so as to have a relatively long slant portion D, and thus the edge of one end (right end in FIG. 4) of a liquid-paste 56 coated area (adhesion area) is limited to the position which is far away from the back portion 58 of the packing case 50 by the length L.

Therefore, since no liquid paste 56 is coated beneath a corner portion 54*a* of the third folding plate 54, the corner portion 54*a* is floated as shown in FIG. 5 after the third folding plate 54 is adhesively attached onto the first folding plate 52, and if it is more severely floated, it might peel off.

If the end portion of the liquid-paste 56 coated area in its length direction (adhesion length) is forcedly extended to the back portion 58 in order to prevent the peel-off state of the corner portion 54*a*, that is, the length L from the back portion 58 is forcedly shortened, the end portion of the adhesion area is overlaid on the gap of the slant portion D at the boundary portion between the first and second folding plates 52, 53, so that a part of the liquid paste 56 invades through the gap into the packing container 50.

Therefore, the liquid paste 56 may adhere to the video tape cassette accommodated in the packing case 50, and thus the video tape cassette may adhere to the inside of the packing case 50, so that it cannot be taken out from the packing case 50, or the adhesion of the liquid paste 56 to the video tape cassette deteriorates the quality of the video tape cassette as an article of commerce, or makes a user feel uncomfortable.

SUMMARY OF THE INVENTION

Therefore, the present invention has been implemented in view of the foregoing problem, and has an object to provide a packing case which can prevent floating of a corner portion of an upper folding plate adhering onto a lower folding plate at an overlap portion, and also prevent invasion of liquid paste through the gap of the boundary portion of the folding plates into the packing case.

In order to attain the above object, according to the present invention, a box-shaped packing case having an overlap portion at which a third folding plate folded from a first folding direction is adhesively attached onto and overlaid on first and second folding plates which are folded from two directions different from the folding direction of the third folding plate so that the boundary portions thereof are not overlapped with each other, is characterized in that the shape of the boundary portion of the first and second folding plates when the first and second folding plates are folded are designed so that the length of an adhesion area to which the third folding plate adheres approaches to the length of the third folding plate at a maximum irrespective of the boundary portion.

According to the packing case thus constructed, the shapes of the boundary portions of the first and second folding plates which are folded from two directions are designed so that the adhesion length of the third folding plate which is folded from another direction so as to be adhesively attached onto the first and second folding plates approaches to the length of the third folding plate at a maximum irrespective of the boundary portions. Therefore, the corner portion of the third folding plate can be prevented from being floated and also liquid paste can be prevented from invading through the gap portion between the boundary portions of the first and second folding plates into the packing case.

DETAILED DESCRIPTION OF THE PREFERRED EMBODIMENT

A preferred embodiment according to the present invention will be described hereunder with reference to the accompanying drawings.

FIGS. 6 to 9 are diagrams showing a packing case 20 for accommodating a video tape cassette according to a first embodiment of the present invention.

Figure 6:
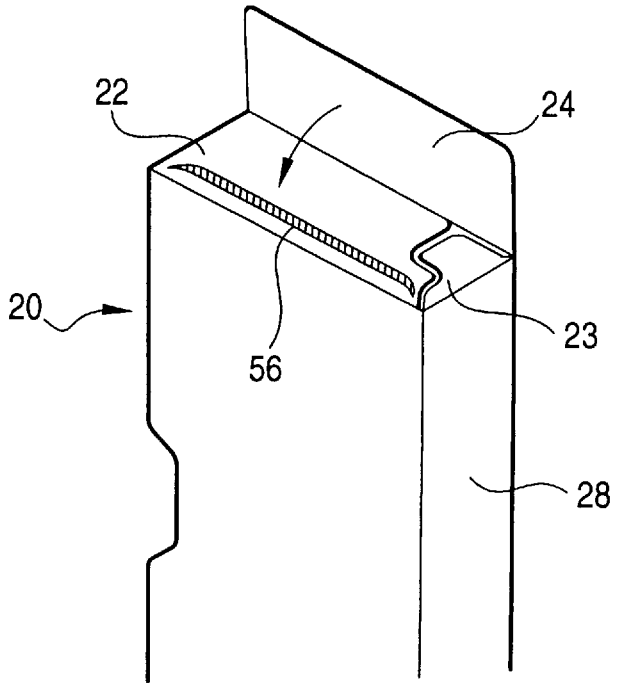
FIG. 6 is a partially perspective view showing a state during a fabrication process of a packing case according to an embodiment of the present invention.
Figure 7:
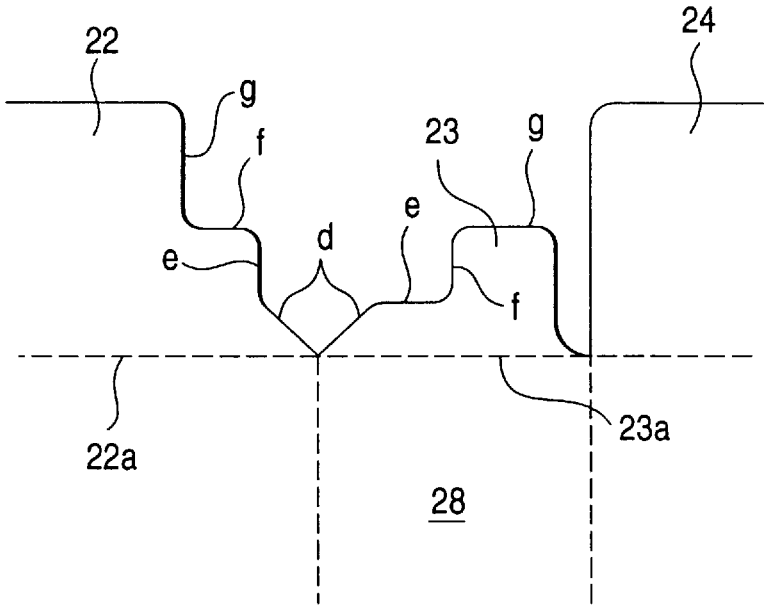
FIG. 7 is a partial development of the periphery of a second folding plate of the packing case of FIG. 6.

FIG. 6 is a perspective view showing a state of one end portion of the packing case 20 of the video tape cassette during a fabrication process. As shown in FIG. 6, each of both the end portions of the packing case 20 in its longitudinal direction (up-and-down direction) is constructed by an overlap portion. That is, at the overlap portion, the first and second folding plates 22, 23 are folded from two directions, and the outer shape of each boundary portion is designed so that the first and second folding plates 22, 23 are not overlapped with each other when they are folded (see FIGS. 6 and 8).

As shown in FIG. 6, the third folding plate 24 which is folded from another direction is overlaid on the first and second folding plates 22, 23. At this time, the third folding plate 24 is adhesively attached onto the first folding plate 22 through liquid paste 56 coated at a predetermined position shown in FIG. 6 on the first folding plate 22.

Figure 8:
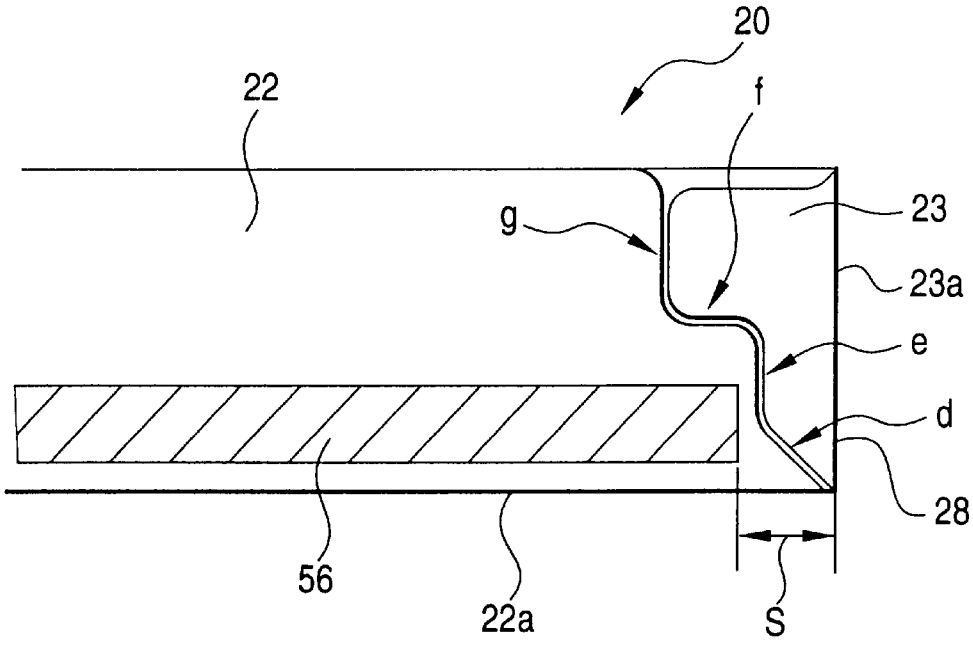
FIG. 8 is a top view showing the periphery of the second folding plate of the packing case in FIG. 6.

As shown in FIG. 8, the boundary portion between the first and second folding plates 22 and 23 when the first and second folding plates 22 and 23 are folded from the two directions is constructed by a slant line d extending obliquely from the intersection point between the folding line 22*a* of the first folding plate 22 and the folding line 23*a* of the second folding plate 23, and three straight lines e, f, g which are linked to the slant line d and parallel to any one of the folding lines 22*a* and 23*b* and are linked to one another so as to be bent in a step shape.

The straight line e which is linked to the slant line d is disposed so as to be far away from the folding line 22*a* of the first folding plate 22 and extend in parallel to the folding line 23*a* of the second folding plate 23, thereby forming the boundary portion between the first folding plate 22 and the second folding plate 23.

Figure 1:
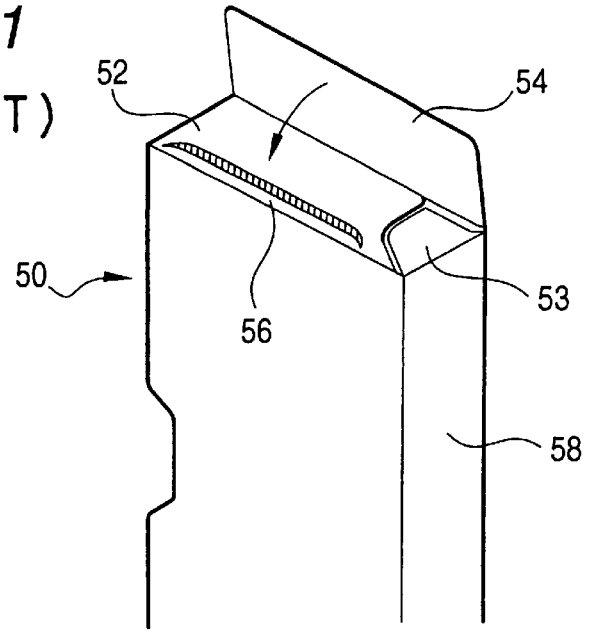
FIG. 1 (PRIOR ART)
FIG. 1 is a partial perspective view showing a state during a fabrication process of a conventional packing case.
Figure 2:
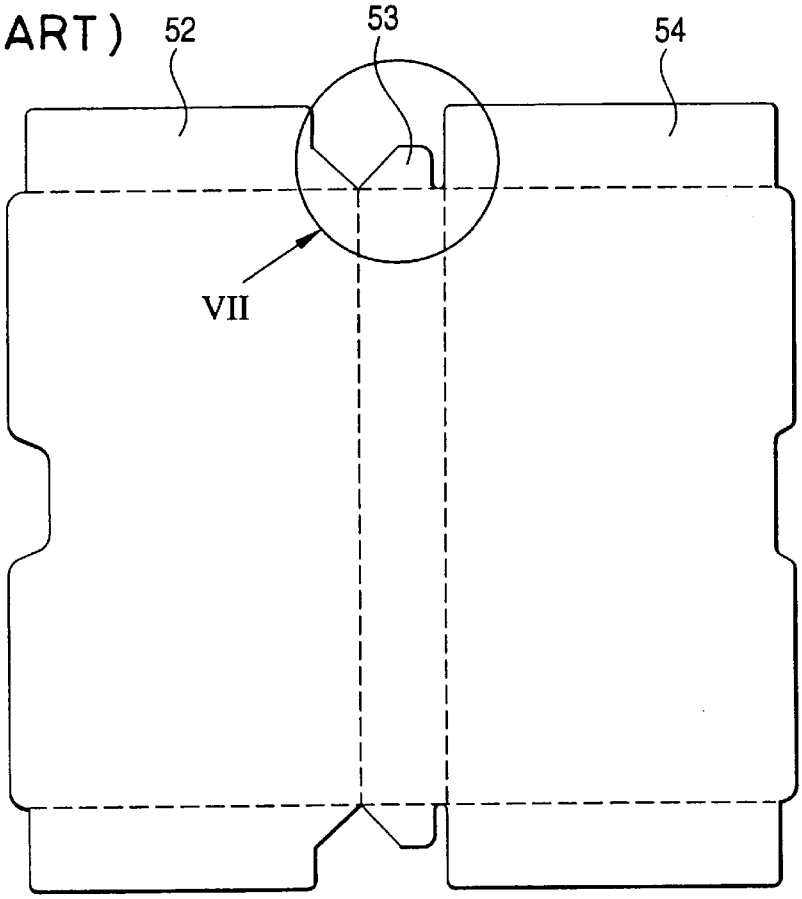
FIG. 2 (PRIOR ART)
FIG. 2 is an overall development showing the packing case of FIG. 1.
Figure 3:
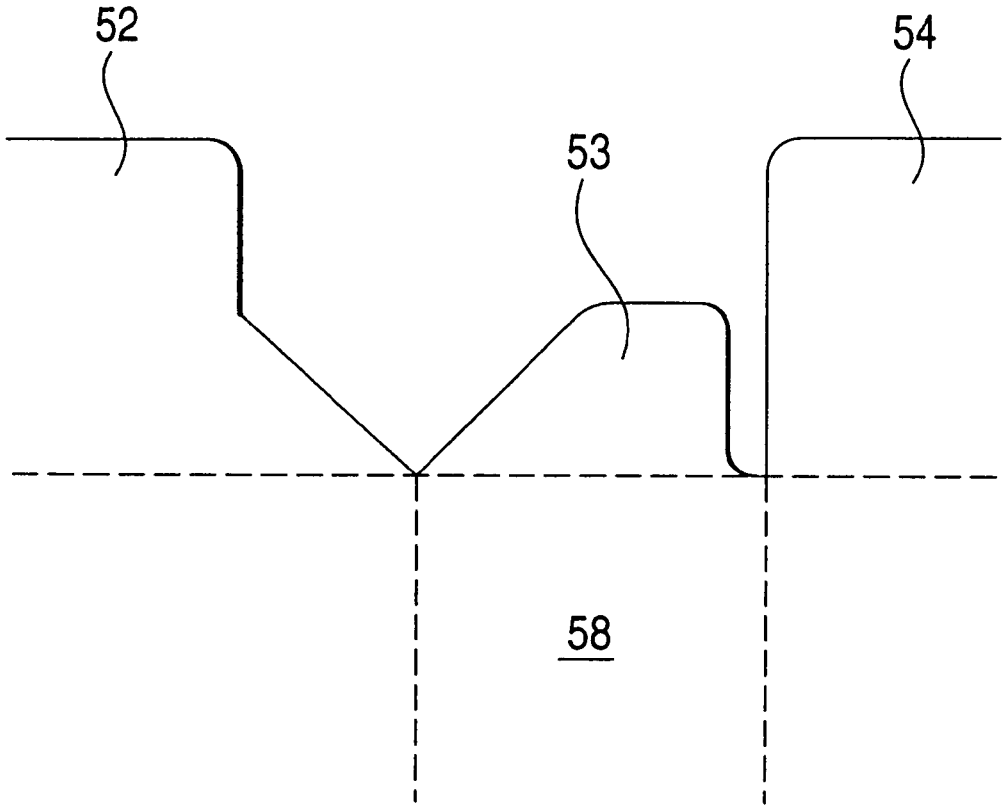
FIG. 3 (PRIOR ART)
FIG. 3 is a partial development showing the periphery of a second folding plate shown in a circle indicated by an arrow in FIG. 2.
Figure 4:
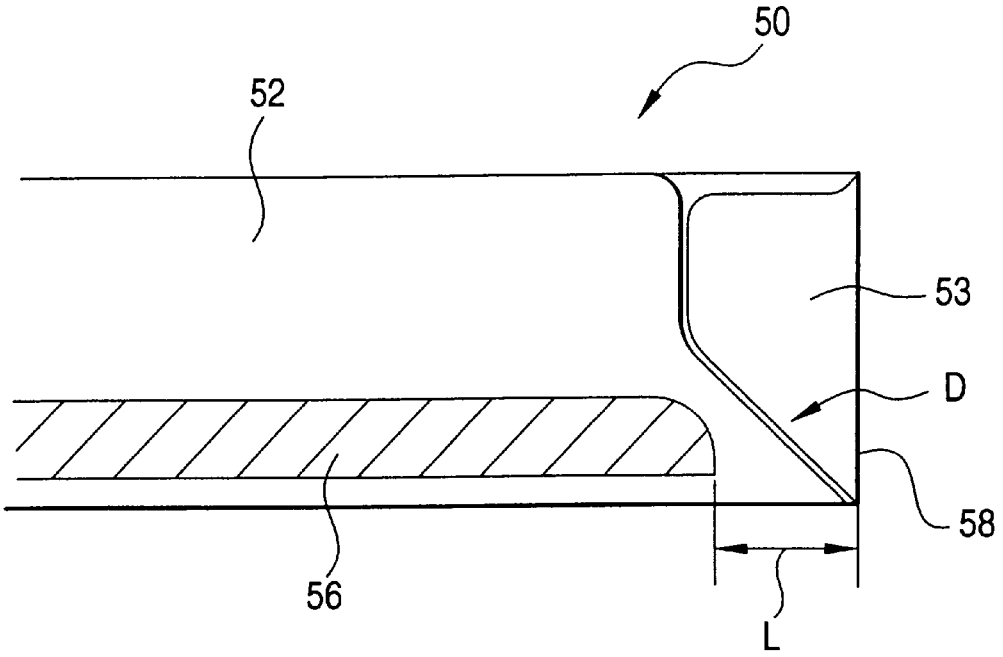
FIG. 4 (PRIOR ART)
FIG. 4 is a top view showing the periphery of the second folding plate 53 of the packing case of FIG. 1.
Figure 5:
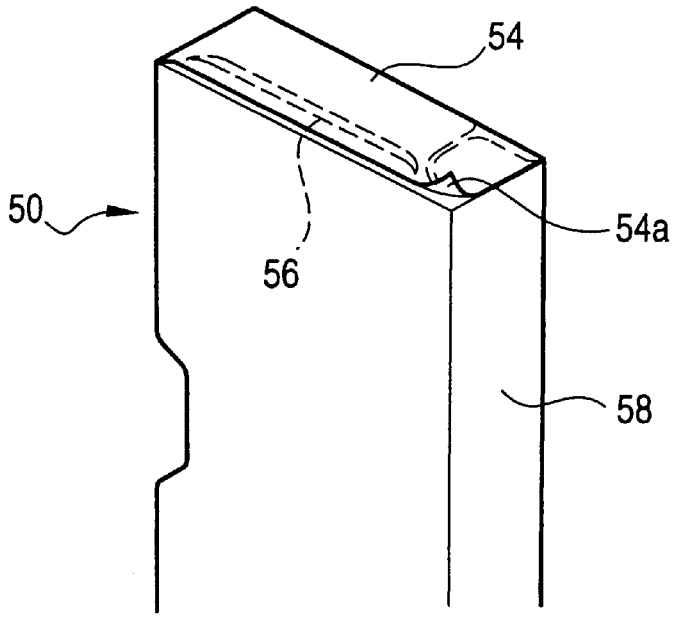
FIG. 5 (PRIOR ART)
FIG. 5 is a partial perspective view showing a state after the adhesion of a third folding plate of the packing case of FIG. 1.

The boundary portion is formed as described above, so that the length of the slant line d extending obliquely from the intersection point between the folding line 22*a* of the first folding plate 22 and the folding line 23*a* of the second folding plate 23 can be set to be remarkably shorter than the length of the slant line D of the boundary portion in the conventional packing case shown in FIG. 4.

Further, the straight line e is bent from the slant line d so as to extend far away from the folding line 22*a* of the first folding plate 22 and in parallel to the folding line 23*a*. Accordingly, the length of the coating area (adhesion length) of the liquid paste 56 can be set to be longer than the adhesion length of the liquid paste 56 of the conventional packing case 50 by about 5 to 8 mm.

Figure 9:
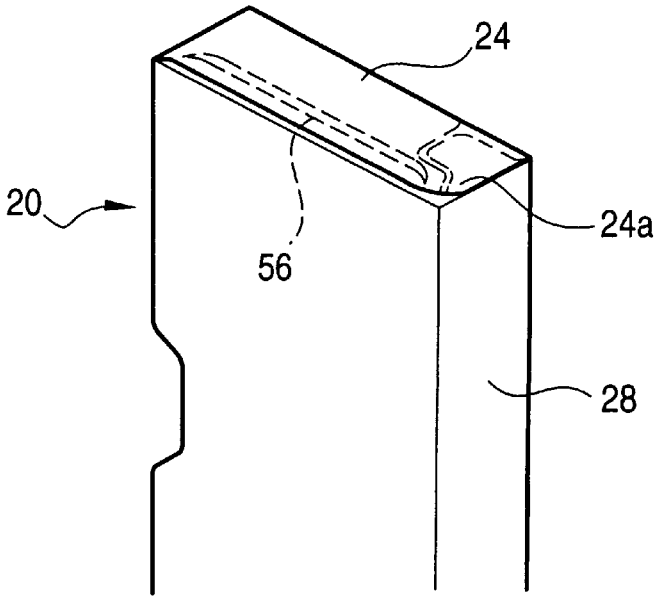
FIG. 9 is a partial perspective view showing a state after the adhesion of a third folding plate of the packing case of FIG. 6.

That is, in FIG. 8, the edge of the coating area of the liquid paste 56 in its longitudinal direction can be extended to the position which is separated from the back portion 28 by the length S. The length S can be set to be shorter by about 5 to 8 mm than the length L from the back portion 58 to the edge of the coating area of the liquid paste 56 in the conventional packing case shown in FIG. 4. Therefore, the corner portion 24*a* of the third folding plate 24 can be prevented from being floated as shown in FIG. 9 after the third folding plate 24 is adhesively attached onto the first folding plate 22 as shown in FIG. 6, and thus the outer style of the packing case can be enhanced.

Further, since the floating of the corner portion 24*a* of the third folding plate 24 can be prevented, it is unnecessary to forcedly approach the end portion of the coating area of the liquid paste 56 to the back portion 28, and thus the liquid paste 56 can be prevented from invading through the gap portion of the boundary portion of the first and second folding plates 22 and 23 into the packing case 20.

Therefore, there can be surely prevented such troubles that the liquid paste 56 invades into the packing case 20 and adheres to the video tape cassette accommodated in the packing case 50, so that the video tape cassette adheres to the inside of the packing case 50 and it cannot be taken out from the packing case 50, or the adhesion of the liquid paste 56 to the video tape cassette deteriorates the quality of the video tape cassette as an article of commerce, or makes a user feel uncomfortable.

In the above embodiment, the boundary portion between the first and second folding plates 22,23 which are folded is constructed by one slant line d and a step-shaped line comprising three straight lines e, f, g. However, the boundary portion may be designed so as to have any other shapes insofar as the length of the adhesion area between the first and third folding plates 22 and 24 can be approached to the length of the third folding plate 24 at a maximum. For example, the boundary portion may be constructed by a curved line which is similar to the shape of the lines d, e, f, g constituting the shape of the boundary portion shown in FIG. 8.

Still further, in this embodiment, the present invention is applied to a packing case in which a video tape cassette is accommodated. However, the present invention may be applied to another type packing case in which something other than the video tape cassette is accommodated.

The present invention is not limited to the above embodiment, and various modifications may be made on the basis of the technical idea of the present invention.

As described above, according to the packing case of the present invention, the corner portion of the upper folding plate adhering onto the lower folding plate at the overlap portion can be prevented from being floated, and a part of the liquid paste can be also prevented from invading through the gap of the boundary portion of the folding plates into the packing case.

What is claimed is:

1. A box-shaped packing case comprising an overlap portion at which a third folding plate folded from a first folding direction is adhesively attached onto and overlaid on first and second folding plates folded from two directions different from the first folding direction of the third folding plate, so that boundary portions of the first and second folding plates are not overlapped with each other, characterized in that a shape of the boundary portions between said first and second folding plates when said first and second folding plates are folded is selected so that a length of an adhesion area at which said third folding plate is adhered approaches a length of said third folding plate, wherein the shape of the boundary portion between said first and second folding plates if formed by:

one slant line extending obliquely from an intersection point between folding lines of said first and second folding plates, and three straight lines which are linked to the slant line, parallel to any one of the folding lines and linked to one another, so as to be bent in a stepped shape as a whole.

2. The packing case as claimed in claim 1, wherein the straight line which is directly connected to the slant line is disposed so as to extend away from the folding line of said first folding plate and so as to be parallel to the folding line of said second folding plate.

* * * * *